US006220125B1

(12) United States Patent
Lan

(10) Patent No.: US 6,220,125 B1
(45) Date of Patent: Apr. 24, 2001

(54) DEVICE FOR ADJUSTING ANGLE OF RATCHET WRENCH

(76) Inventor: Lai Lee Yu Lan, 7 Lane 509, Pei Tung Road, Pei Tung District, Taichung (TW)

( * ) Notice: Subject to any disclaimer, the term of this patent is extended or adjusted under 35 U.S.C. 154(b) by 0 days.

(21) Appl. No.: 09/448,901

(22) Filed: Nov. 29, 1999

(51) Int. Cl.[7] ..... B25B 23/16
(52) U.S. Cl. ..... 81/177.9; 403/93
(58) Field of Search ..... 81/177.7, 177.8, 81/177.9; 403/93

(56) References Cited

U.S. PATENT DOCUMENTS 2,608,894 * 9/1952 Miller, Jr. et al. .
4,463,632 * 8/1984 Parke ..... 81/177.9
4,711,145 * 12/1987 Inoue ..... 81/177.8 X
4,794,829 * 1/1989 Mesenhoeller ..... 81/177.8
4,901,608 * 2/1990 Shieh ..... 81/177.8
5,862,723 * 1/1999 Rowlands ..... 81/177.9
6,000,302 * 12/1999 Chiang ..... 81/177.8
6,053,076 * 4/2000 Barnes ..... 81/60

* cited by examiner

*Primary Examiner*—D.S. Meislin
(74) *Attorney, Agent, or Firm*—Harrison & Egbert

(57) ABSTRACT

A ratchet wrench is provided with an angle adjusting device having drive head, a handle, and a button. The drive head is provided at one end thereof with a pivoting end. The handle is provided at one end thereof with two pivoting lugs for fastening the pivoting end of the drive head. The handle is further provided at one end thereof with a receiving slot for receiving the button in conjunction with a spring and a steel ball. The button is provided with an eccentric slot for receiving the spring, a notch corresponding in location to the ball-locating slots of the pivoting end of the drive head, and an inclined plane. The button is urged by the spring such that the steel ball is forced by the inclined plane of the button to locate in one of the ball-locating slots of the pivoting end of the drive head. As the button is pressed, the steel ball is located in the notch of the button to enable the drive head to be adjusted angularly in relation to the handle.

1 Claim, 5 Drawing Sheets

DEVICE FOR ADJUSTING ANGLE OF RATCHET WRENCH

FIELD OF THE INVENTION

The present invention relates generally to a ratchet wrench, and more particularly to an angle adjusting device of the ratchet wrench.

BACKGROUND OF THE INVENTION

As shown in FIG. 1, the Taiwan Patent No. 82202299 discloses a ratchet wrench comprising a button 2 and a drive head 3. The drive head 3 has a connection rod 4 which is received within an insertion hole 5. The button 2 has a rack 1, which is engaged with the insertion hole 5 in which a corresponding rack is provided. When the button 2 is pressed, the rack 1 of the button 2 is disengaged with the insertion hole 5 so as to enable the drive head 3 to be bent to form a predetermined angle with the handle 6. As soon as the button 2 is relieved of the pressure exerting thereon, the button 2 is forced by the elastic force of a spring 7 to return to its original position. Such a prior art ratchet wrench as described above is defective in design in that the rack 1 of the button 2 is prone to displace and jam in the insertion hole 5. In order to prevent the jamming of the rack 1, it is necessary to turn the button 2 gently. The user of the prior art ratchet wrench is often annoyed by such inconvenience.

As shown in FIGS. 2 and 3, the Taiwan Patent Nos. 82210906 and 83206013 disclose respectively a ratchet wrench comprising a rod body 9 which is provided with a cam 8 for supporting an arresting member 10 so as to retain the drive head 11. The rod body 9 is not provided with a means for causing the rod body 9 to return to its original position automatically. As a result, the user of such prior art ratchet wrenches must keep turning the rod body 9 at the same time as when the prior art ratchet wrenches are at work. In addition, the contact area of the drive head 11 and the arresting member 10 is smooth and is vulnerable to deformation.

Now referring to FIG. 4, the Taiwan Patent No. 8221506 discloses a ratchet wrench, which comprises a drive head 12 having two lugs 13 and a steel ball 14 located between the two lugs 13. The steel ball 14 is intended to engage any one of the retaining slots 17 of the pivoting end 16 of the handle 15. One of the two lugs 13 of the drive head 12 is provided with a hole 18 for receiving a spring pull member 19 which has a protruded rod 20. The pivoting end 16 of the handle 15 is provided with a plurality of insertion holes 21. The protruded rod 20 is inserted into one of the insertion holes 21. In order to bend the drive head 12, it is necessary to pull the spring pull member 19 so as to cause the protruded rod 20 to disengage the insertion hole 21 of the handle 15. In the meantime, the steel ball 14 constantly supports any angle of any corresponding retaining slots 17 of the pivoting end 16 of the handle 15.

It is therefore readily apparent that the prior art ratchet wrenches are complicated in construction and are therefore not cost-effective. In addition, the prior art ratchet wrenches can not be used with ease and convenience.

SUMMARY OF THE INVENTION

The primary objective of the present invention is to provide a ratchet wrench with an angle adjusting device which is free from the deficiencies of the prior art devices described above.

In keeping with the principle of the present invention, the foregoing objective of the present invention is attained by an angle adjusting device comprising a drive head, a handle, and a button. The drive head has a pivoting end at one end thereof. The handle has two pivoting lugs for fastening the pivoting end of the drive head at one end thereof. The handle also has a receiving slot for disposing the button in conjunction with a spring and a steel ball at one end thereof. The button has an OFF center slot for receiving the spring, a notch corresponding in location to a ball slot of the pivoting end of the drive head, and an inclined plane. The button is supported by the spring such that the steel ball is forced by the inclined plane of the button to reside in the ball slot of the pivoting end of the drive head. As the button is pressed, the steel ball falls back into the notch of the button to enable the drive head to be adjusted angularly.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
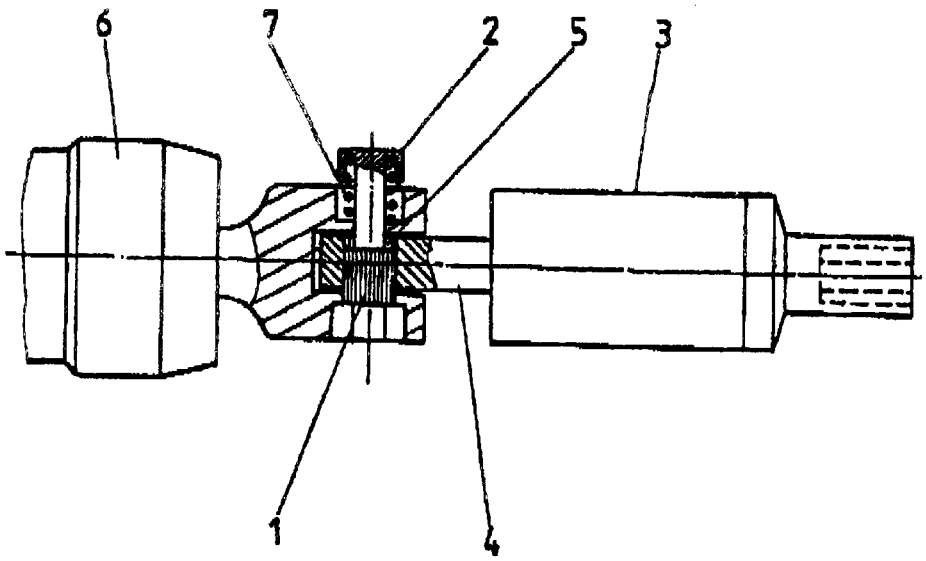
FIG.1 PRIOR ART
FIG. 1 shows a schematic plan view of a ratchet wrench of the Taiwan Patent No. 82202299.
Figure 4:
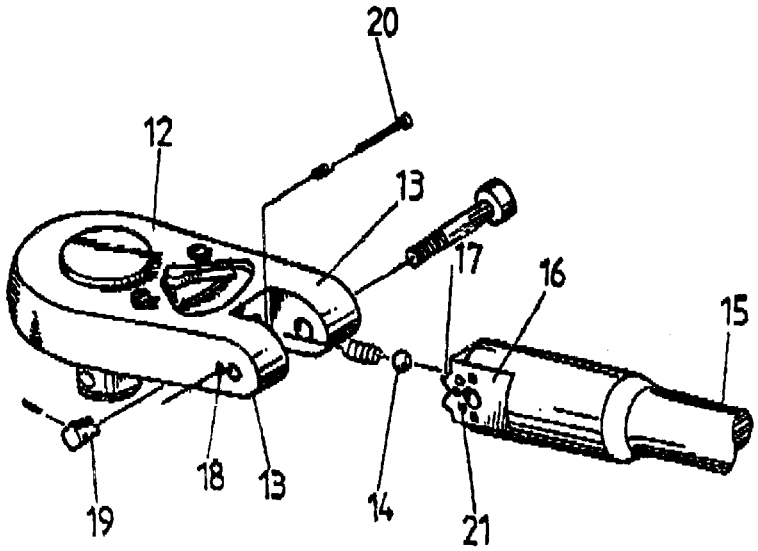
FIG.4 PRIOR ART
FIG. 4 shows an exploded view of a ratchet wrench of the Taiwan Patent No. 82215064.
Figure 2:
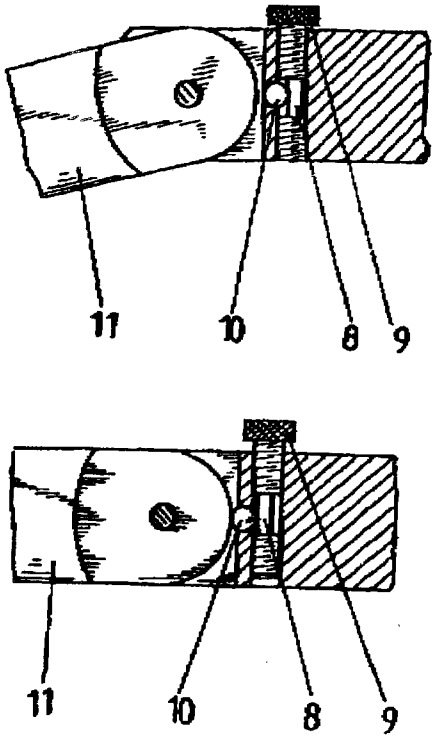
FIG. 2 PRIOR ART
FIG. 2 shows a perspective view of a ratchet wrench of the Taiwan Patent No. 82210906.
Figure 3:
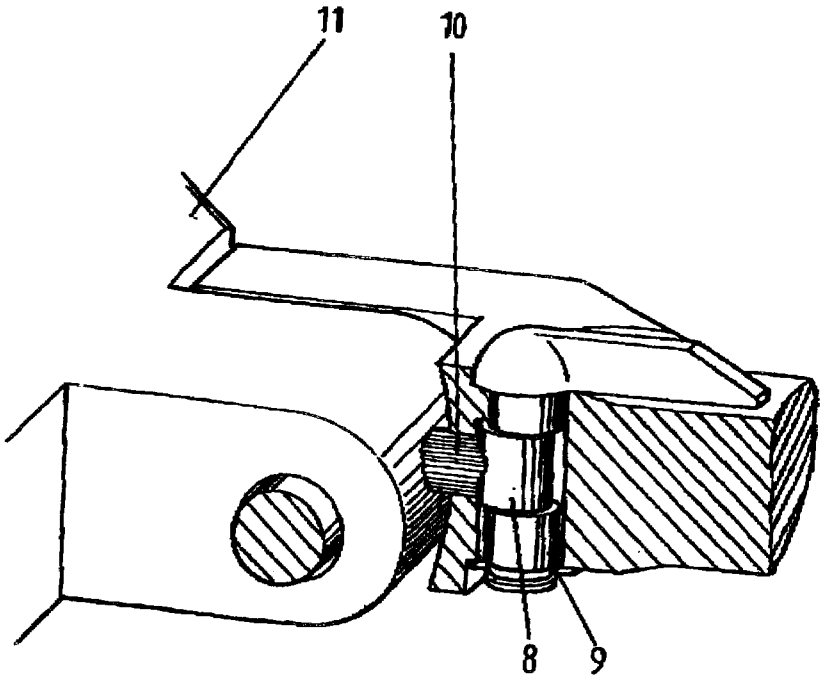
FIG. 3 PRIOR ART
FIG. 3 shows a schematic plan view of a ratchet wrench of the Taiwan Patent No. 83206013.
Figure 5:
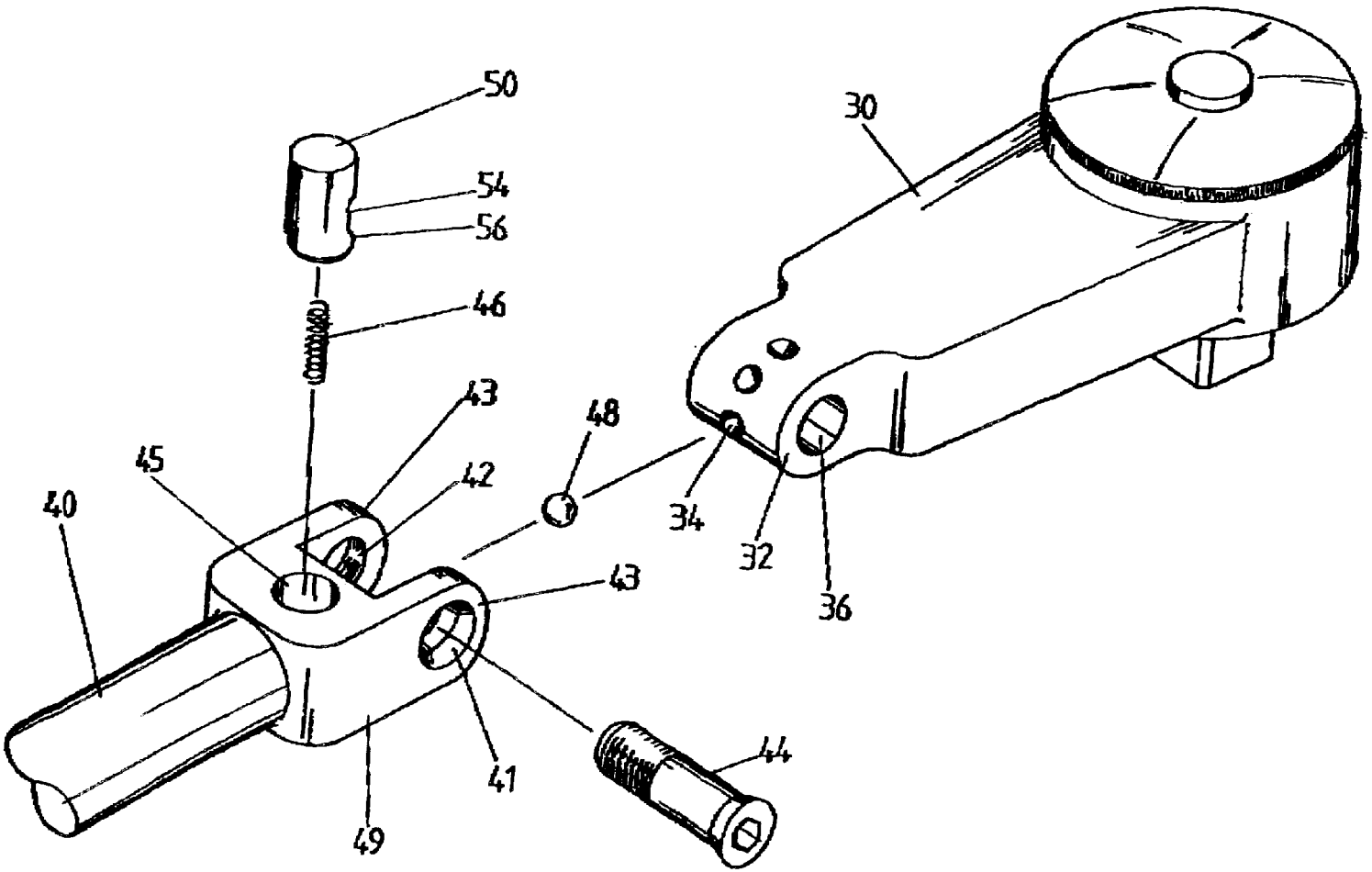
FIG. 5 shows an exploded view of the preferred embodiment of the present invention.
Figure 6:
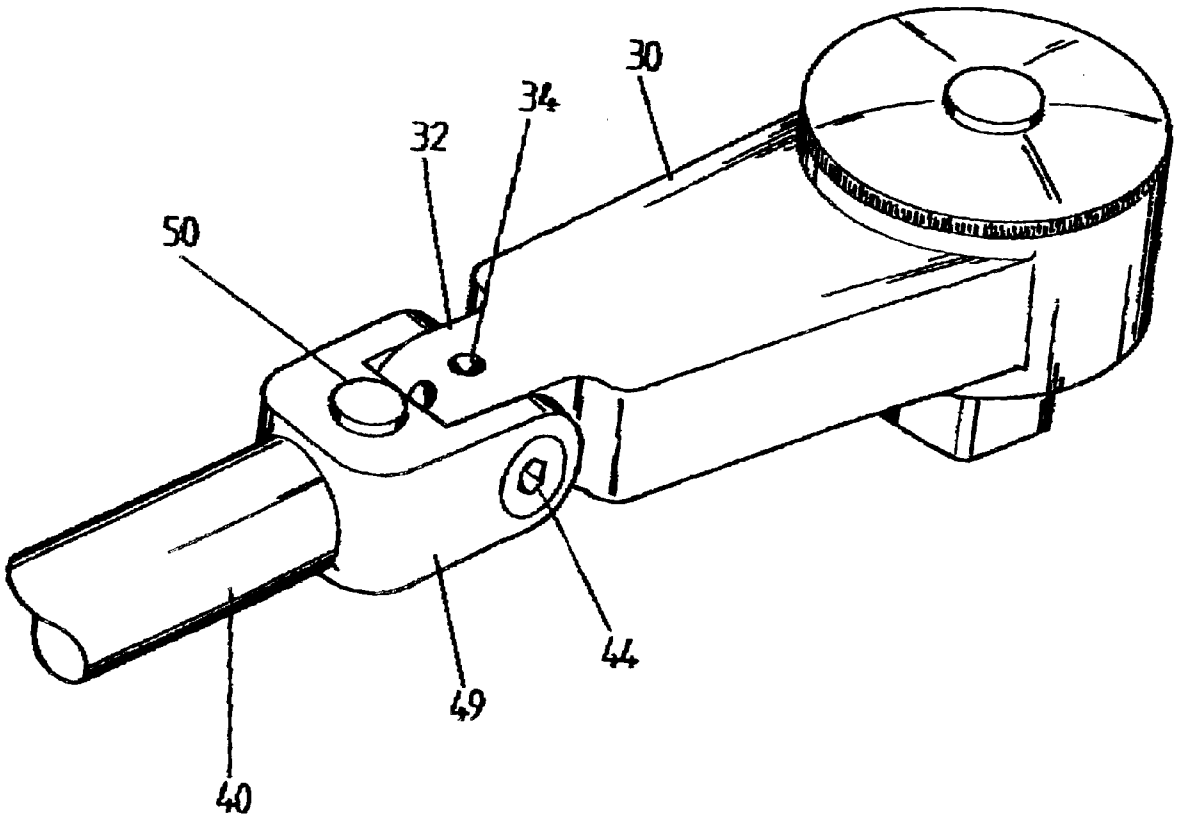
FIG. 6 shows a perspective view of the preferred embodiment of the present invention.

As shown in FIGS. 5–8, the preferred embodiment of the present invention comprises a drive head 30, a handle 40, and a button 50.

The drive head 30 is provided at one end thereof with a pivoting end 32 which is in turn provided with a plurality of ball-locating slots 34 and a through hole 36.

The handle 40 is provided at a pivoting end 49 thereof with two pivoting lugs 43, with each having a fisheye hole 41 and a threaded hole 42. The pivoting end 32 of the drive head 30 is fastened pivotally between the two pivoting lugs 43 of the handle 40 by a sunk-head bolt 44 which is received in the through hole 36 of the pivoting end 32 of the drive head 30 and the threaded hole 42 of the two pivoting lugs 43 of the handle 40. The pivoting end 49 of the handle 40 is further provided with a receiving slot 45 for receiving a spring 46 and the button 50. The receiving slot 45 is provided in the midsection thereof with an open area 47 for receiving a steel ball 48.

The button 50 is provided with a longitudinal OFF-center spring slot 52, a notch 54, and an inclined plane 56. The OFF-center spring slot 52 is intended to receive the spring 46.

Figure 7:
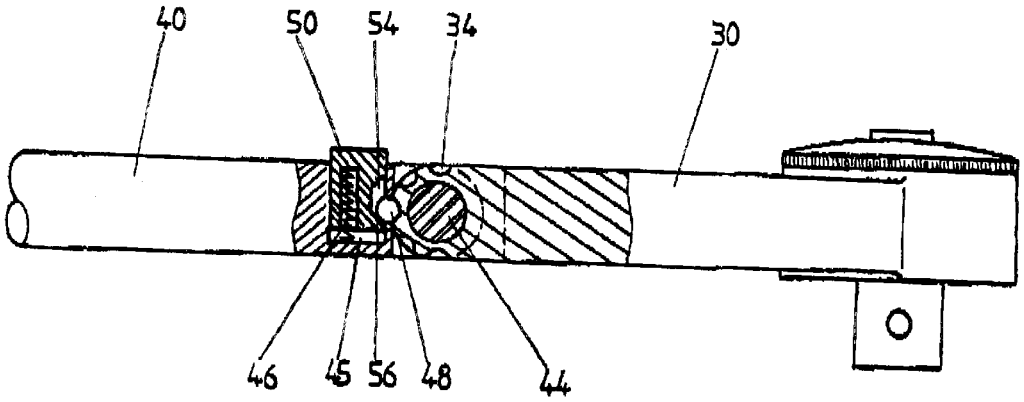
FIG. 7 shows a sectional schematic view of the preferred embodiment of the present invention.
Figure 8:
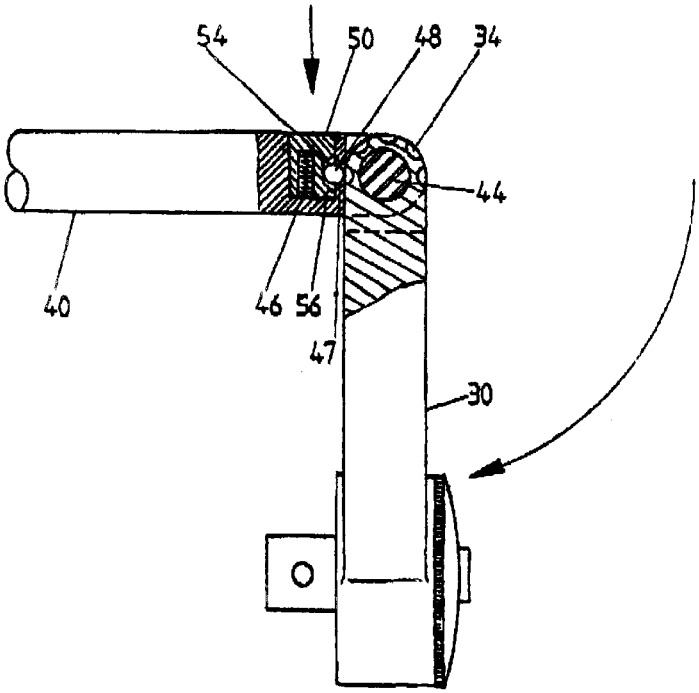
FIG. 8 shows a schematic view of the preferred embodiment of the present invention at work.

In operation, the button 50 is mounted in the receiving slot 45 of the pivoting end 49 of the handle 40 such that the upper end of the button 50 extends outwardly of the upper end of the receiving slot 45 because the spring action of the spring 46. The steel ball 48 is located at the notch 54 of the button 50 to prevent the button 50 from slipping out of the receiving slot 45. As shown in FIG. 7, the button 50 is supported by the spring 46 such that the steel ball 48 slides down the inclined plane 56 of the button 50 to exit of the open slot 47 and to enter in the ball-locating slot 34. Now referring to FIG. 8, as the button 50 is pressed, the steel ball 48 falls back into the notch 54 so as to enable the drive head 30 to form a new angle with the handle 40. As soon as the button 50 is relieved of the pressure exerting thereon, the button 50 returns to its original position.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

I claim:

1. A device for angularly adjusting a ratchet wrench, the device comprising:

a drive head having a pivoting end, said pivoting end having a plurality of ball-locating dimples formed on a surface thereof, said pivoting end having a through hole formed therein;

a handle having a pivoting end with two lugs extending outwardly therefrom, said two lugs having respectively a fisheye hole and a threaded hole, said pivoting end of said handle having a receiving slot provided at a midsection thereof, said pivoting end of said handle having an open slot formed therein, said two lugs being pivotally fastened to said pivoting end of said drive head by a sunk-head bolt received in said through hole and received by said fisheye hole and said threaded hole; and a button having a longitudinal eccentric slot and a notch and an inclined plane formed on only one side of said button, said button being disposed in said receiving slot, said button having a spring received in said eccentric slot so as to urge a portion of said button to extend outwardly of said receiving slot when pressure is not applied to said button, said notch having a steel ball therein for retaining said button in said receiving slot, said spring urging said button into a position in which said inclined plane contacts said steel ball such that said steel ball moves outwardly of said open slot and into one of said ball-locating dimples of said drive head so as to prevent said drive head from rotating relative to said handle, said button movable to a position in said receiving slot such that said steel ball moves into said notch so as to enable said drive head to pivot relative to said handle.

* * * * *